United States Patent [19]

Hofmann

[11] 4,398,670

[45] Aug. 16, 1983

[54] FUEL INJECTION VALVE FOR AN INTERNAL COMBUSTION ENGINE

[75] Inventor: Karl Hofmann, Remseck, Fed. Rep. of Germany

[73] Assignee: Robert Bosch GmbH, Stuttgart, Fed. Rep. of Germany

[21] Appl. No.: 283,356

[22] Filed: Jul. 14, 1981

[30] Foreign Application Priority Data

Aug. 6, 1980 [DE] Fed. Rep. of Germany ..... 3029721

[51] Int. Cl.[3] ..... F02M 61/20

[52] U.S. Cl. ..... 239/533.9; 239/533.11

[58] Field of Search ..... 239/533.2–533.13, 239/585; 73/119 R, 119 A; 123/612

[56] References Cited

U.S. PATENT DOCUMENTS

| | | | |
|---|---|---|---|
| 4,313,571 | 2/1982 | Bellicardi | 239/585 |
| 4,340,181 | 7/1982 | Stumpp et al. | 239/533.3 |

FOREIGN PATENT DOCUMENTS

| | | | |
|---|---|---|---|
| 2748447 | 5/1978 | Fed. Rep. of Germany | 239/533.9 |
| 2024934 | 6/1978 | United Kingdom | 239/533.9 |

*Primary Examiner*—John J. Love
*Assistant Examiner*—Gene A. Church
*Attorney, Agent, or Firm*—Frishauf, Holtz, Goodman & Woodward

[57] ABSTRACT

To provide for electrical insulation between a movable valve element sealing the nozzle opening (28) of a fuel injection valve, the valve body (10, 11, 12, 13) is formed of a metal and shaped to be secured to the engine block of an internal combustion engine, and the needle valve element (15, 18) has a valve seat (17) fitting against a matching sealing surface (16) in the valve body, the valve pin element being electrically insulated from the valve body, while retained therein in reciprocable sliding connection on a guide surface by placing an aluminum sleeve or jacket around the pin and forming a coating of aluminum oxide by anodic oxidation on the outside of the aluminum sleeve to, simultaneously, provide for a wear-resistant and insulating surface capable of maintaining the valve pin in slidable, reciprocating position within the valve body while providing for electrical insulation with respect thereto, the valve pin being electrically connected to an external terminal (50, 52) to permit obtaining an electrical signal between the engine block and the terminal indicative of whether the valve elements (16, 17) controlling fuel flow through the nozzle (28) are closed or open, the valve seat elements (16, 17) themselves forming a severable electrical connection between the valve pin (15, 18) and the body due to the insulation of the valve pin by the aluminum oxide layer.

4 Claims, 1 Drawing Figure

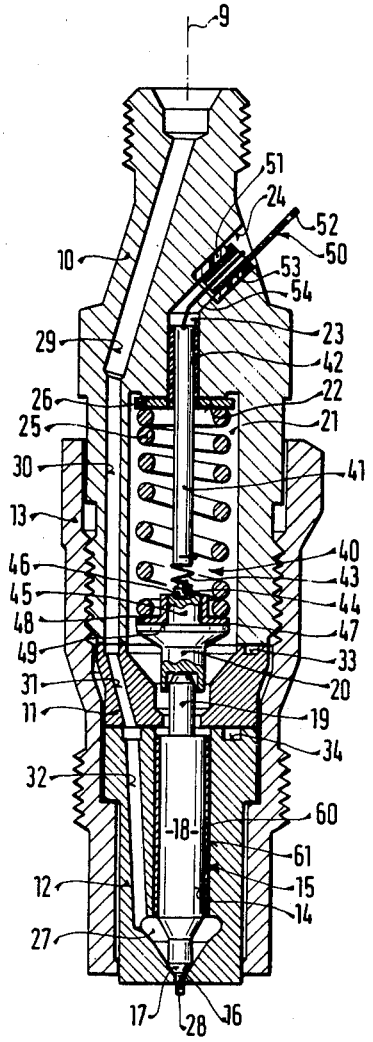
9
51
24
52
50
10
53
54
23
29
42
22
26
21
25
41
30
13
40
46
43
45
44
48
47
49
33
31
20
11
19
34
32
60
18
61
12
15
14
27
17
28
16

FUEL INJECTION VALVE FOR AN INTERNAL COMBUSTION ENGINE

The present invention relates to a fuel injection valve for an internal combustion engine, and more particularly to a fuel injection valve which, besides carrying out the fuel injection function, provides an electrical feedback signal indicative of valve operation.

BACKGROUND

Fuel injection valves have been proposed in which the valve itself is a needle valve and includes an electrical switching function by placing an insulating layer between the needle shaft and the guide bore within the valve body so that, when the needle is seated in the valve body, a closed electrical circuit is established between the needle and the valve body and, when the needle is lifted off the valve body, permitting injection of fuel, the circuit is broken. The change in the electrical circuit state of the valve provides an output signal which can be analyzed to provide a feedback signal representative of valve operation. It has been suggested to provide an insulating layer between the needle shaft or needle body of the needle valve and its guide bore in form of a wear-resistant plastic material. Such valves, however, apparently would be very difficult to make since the composition of the plastic material, application thereof, and the tolerance range would be difficult to maintain under industrial mass production conditions.

THE INVENTION

It is an object to provide a combined fuel injection valve-switching element which is structurally similar to standard valves without the switching function, and which can readily made under mass production conditions.

Briefly, the needle valve element is separated from the remainder of the valve body by an insulating layer which comprises aluminum oxide. This insulating layer, preferably, is made by anodic oxidation of an aluminum sleeve which, for example, is secured to the shaft of the needle, the outer circumference of the sleeve carring the aluminum oxide layer. The needle valve itself may be made of steel.

The valve-switch combination has the advantage that the insulating layer of aluminum oxide will be a hard coating layer and will meet the requirements with respect to insulation, hardness and resistance against wear, while not requiring excessive complications in production.

DRAWING

The single FIGURE is a vertical sectional view through a fuel injection valve, in which the valve itself is shown to an enlarged scale relative to an actual production model.

The valve is made primarily of electrically conductive materials. It has a central axis 9, about which the valve body 10 is rotation-symmetrical. Most of the components, likewise, are rotation-symmetrical. The body 10 is a base body which is joined to an intermediate plate 12 and a valve body 13 by an outer sleeve-like nut which holds the parts 10, 11, 12 together. The valve body 12 is formed with a valve orifice which can be closed off by a needle valve 15. The needle valve 15 is guided in a guide bore 14 formed in the valve body 12, and includes a needle shaft or pin 18 which, at its terminal end, is formed with a sealing cone 17 which fits against the valve seat 16 of the body 12. A pressure pin 19 extends from the other end of the body 18. The pin 19 is in engagement with a connecting bolt 20.

The body 10 is formed with a central bore 21, open at one end, which retains a spring 25 therein. The end wall 22 of the bore 21 is continued outwardly to form an outwardly extending opening 24. The spring 25, with the interposition of a washer 26, bears against the inner wall 22. The other end of the spring engages, over an insulating structure to be described, on the bolt 20.

Fuel is supplied over supply ducts 29, 30, 31, 32 and ring ducts 33, 34 into a pressure chamber 27 of the valve body 12 to be injected into the space outside of the valve through a nozzle opening 28 if the valve body 18 is lifted off the seat 16.

An electrically conductive contact element 40 is provided, the contact element including a contact pin 41 which is secured by an insulationg sleeve 42 in a bore 43. Pin 41 has a connecting spring 43 secured thereto, for example by a clamping or pinch connection, spring 43 being electrically connected to a contacting cone or tip 44 which lies in a groove 46 of bolt 45 and is retained therein by spring pressure, so that electrical contact is reliably and continuously provided between the elements 44, 45. The surface 49 of the pressure bolt 20 has a guide surface 48 thereon which has an insulating coating applied thereto. The insulating coating 47 is made of wear-resistant material in order to insulate the spring 25 with respect to the bolt 20. This is a simple and effective way of insulation, although other insulation arrangements may be used.

Pin 41 is connected to an external terminal 50 by a connecting line 54, soldered to the pin and to a terminal element 52 which, for example, may be a standard automotive-type terminal to be connected, for example, to a pick-up line from a test instrument, a control unit, or the like. A sleeve 53 is seated in an insulating bushing 51 to separate the terminal unit 50 and the terminal strip 52 from the body 10.

The valve pin 18 is insulated from the surrounding portion of the body 12. In accordance with the invention, an aluminum oxide layer 61 effects this insulation. The aluminum oxide layer 61 is applied to the outside of an aluminum sleeve 60 which is secured to the valve pin 15, and the outside of which carries the aluminum oxide layer 61. The layer is generated by anodic oxidation, that is, by anodizing the sleeve 61, to provide both wear resistance and sliding capability to permit the aluminum oxide-coated surface to slide the guide bore 14 of the valve element 12.

The injection valve can be screwed into the engine block of an internal combustion engine—not shown—and, thus, is electrically connected to the chassis of the chassis or ground connection of the engine and, with it, to structural components secured thereto, for example the chassis of an automotive vehicle.

The FIGURE shows the valve in closed condition, that is, the electrical switch formed by the valve seat 16 and the sealing cone 17 is closed, thus providing a closed electrical circuit between body 12 and hence the outer structure of the valve element, and the valve pin 18 and the electrically insulated components 40, 41, 50 extending therefrom and being connected thereto. The switch formed by cone 17 and seat 16, thus, is closed. When the valve opens, due to increase of pressure in the valve chamber 27, pin 18 is lifted off its seat counter the force of the spring 25 and, consequently, the switch formed by the seat 16 and cone 17 will open. Thus, when the injection valve opens to permit fuel to be injected therethrough, the electrical switch 16–17 likewise will be open, since the valve needle 15, the pressure bolt 20, contact pin 41, and the terminal part 50 are insulated with respect to the valve body components 12, 11, 10. Electrical connection between the engine block, that is, ground or chassis of an electrical network, and the terminal 52 of the valve unit will thus be interrupted.

The injection valve is particularly useful as an injection valve in Diesel engines, and provides actual feedback information of opening of the injection valve by furnishing an electrical signal which is representative of the time that the valve is open, that is, when the cone 17 is lifted off the seat 16. This information can be used as feedback of actual valve opening time versus, for example, a commanded valve opening time in an electronic fuel injection system to provide for closed-loop control of quantity of fuel injected; if the pressure of fuel in the valve chamber 27 is known, for example as sensed by a pressure sensor, and the opening time can be determined by opening of the switch, the actual quantity of fuel can be calculated since the volume of the chamber 27 is known and the extent of lift-off of the valve pin 18, and hence the orifice through which fuel can flow and be injected, can be determined from the pressure, the time during which fuel flows being signaled by interruption of a closed electrical circuit between terminals 52 and ground or chassis, that is, an electrical connection to the engine block. Accurate metering of fuel to an internal combustion engine thus can be reliably controlled since the actual operation of the valve, rather than merely a commanded or desired operation, is monitored.

I claim:

1. Fuel injection valve for an internal combustion engine having a valve body (10, 11, 12, 13) of electrically conductive material formed with a central opening (21);

an injection nozzle (16, 28) opening formed at the injection end of the valve body and having an internal sealing surface (16);

a reciprocable needle valve (15–18) located in the valve body and having a metallic valve pin (18) formed with a matching sealing face (17) to seal the nozzle opening when the sealing surfaces are in engagement, and to lift off the sealing surface to permit fuel to be injected;

a spring (25) retained in the central opening of the valve body and bearing against the needle valve to bias the needle valve into closed position;

guide surfaces (14) formed on the valve body and on the needle valve to guide the needle valve in its reciprocating movement;

means electrically insulating the needle valve from the valve body except in the region of the sealing surface;

and electrical connection means (40, 41–46, 54) connecting the needle valve to an external terminal (50, 52), electrically insulated (51) from the valve body;

wherein the needle valve (15) comprises a steel core (18) and an aluminum sleeve or jacket (60) secured to the steel core;

and an aluminum oxide insulating layer (61) formed on the outer surface of the sleeve or jacket to electrically separate the needle valve (15–18) and said valve body (10–13) when the needle valve is lifted off the sealing surface of the injection nozzle.

2. Valve according to claim 1 wherein the insulating layer (61) of aluminum oxide comprises anodically oxidized aluminum.

3. Fuel injection valve for an internal combustion engine having a valve body (10, 11, 12, 13) of electrically conductive material formed with a central opening (21);

an injection nozzle (16, 28) opening formed at the injection end of the valve body and having an internal sealing surface (16);

a reciprocable needle valve (15–18) located in the valve body and having a metallic valve pin body/(18) formed with a matching sealing face (17) to seal the nozzle opening when the sealing surfaces are in engagement, and to lift off the sealing surface to permit fuel to be injected;

a spring (25) retained in the central opening of the valve body and bearing against the needle valve to bias the needle valve into closed position;

guide surfaces (14) formed on the valve body and on the needle valve to guide the needle valve in its reciprocating movement;

means electrically insulating the needle valve from the valve body except in the region of the sealing surface;

and electrical connection means (40, 41–46, 54) connecting the needle valve to an external terminal (50, 52), electrically insulated (51) from the valve body;

wherein the metallic valve pin (18) of the reciprocable needle valve is slidable within the valve body;

and one of said guide surfaces comprises an aluminum sleeve (60) interposed between the valve body and said valve pin body, secured to one of said bodies, and carrying a layer of aluminum oxide (61) forming the electrical insulating means on one of said guide surfaces.

4. Valve according to claim 3 wherein the insulating layer (61) of aluminum oxide comprises anodically oxidized aluminum.

* * * * *